US007004367B1

(12) United States Patent
Shen et al.

(10) Patent No.: US 7,004,367 B1
(45) Date of Patent: Feb. 28, 2006

(54) SAFETY SWITCH FOR AN ELECTRIC NAILER

(75) Inventors: Roger Shen, Taichung (TW); Wen-Pin Lin, Taichung (TW)

(73) Assignee: Acuman Power Tools Corp., Taichung (TW)

( * ) Notice: Subject to any disclaimer, the term of this patent is extended or adjusted under 35 U.S.C. 154(b) by 0 days.

(21) Appl. No.: 10/939,240

(22) Filed: Sep. 10, 2004

(51) Int. Cl.
*B25C 1/04* (2006.01)

(52) U.S. Cl. ..... 227/8; 227/131; 227/156; 173/170

(58) Field of Classification Search ..... 227/8, 227/130, 10, 156, 131; 173/170
See application file for complete search history.

(56) References Cited

U.S. PATENT DOCUMENTS 4,432,483 A * 2/1984 Kuck ..... 227/8
4,483,474 A * 11/1984 Nikolich ..... 227/8
5,118,023 A * 6/1992 Fushiya et al. ..... 227/8
5,605,268 A * 2/1997 Hayashi et al. ..... 227/8
5,687,899 A * 11/1997 Dohi et al. ..... 227/110
5,927,585 A * 7/1999 Moorman et al. ..... 227/132
6,382,492 B1 * 5/2002 Moorman et al. ..... 227/8
6,691,907 B1 * 2/2004 Chang ..... 227/8
6,722,547 B1 * 4/2004 Wang et al. ..... 227/8

* cited by examiner

*Primary Examiner*—Scott A. Smith
(74) *Attorney, Agent, or Firm*—Charles E. Baxley

(57) ABSTRACT

The present invention relates to a safety switch for an electric nailer including a trigger which can return to original state after being pressed. The safety switch comprises a stop portion and a safety member, the stop portion is formed in the electric nailer. The safety member includes a push plate and an abutting portion, and the safety member is fixed in the electric nailer and can return to its original position after being pressed, the push plate serves to cover the trigger, and the abutting portion abuts against the stop portion. Thus, the electric nailer will be in a safe mode automatically when not in use, and an accident of pressing the trigger by mistake can be prevented.

5 Claims, 12 Drawing Sheets

SAFETY SWITCH FOR AN ELECTRIC NAILER

BACKGROUND OF THE INVENTION

1. Field of the Invention

The present invention relates to a safety switch, and more particularly to a safety switch for an electric nailer.

2. Description of the Prior Arts

Electric nailer has become one of the hand tools that are most frequently used, since the nailer and the electric techniques is maturing day by day, and the power supply is also easy available, all these factors make the electric nailer become the user's first choice. The electric nailer is equipped with a safety device for preventing an accident of pressing the trigger by mistake, so how to make a safety device completely capable of eliminating such kind of accident has become the problem that the user and the producer most want to solve, and also this is the motivation of the present invention.

Referring to FIGS. 1 and 2, which show a conventional electric nailer equipped with a safety switch. When a locking portion 11 of a trigger 10 is not engaged in a recess 12 on an inner side of the trigger 10, a protrusion 111 of the locking portion 11 cannot be locked with a safety portion 21 of the main body 20 of a nailer. At this moment, the trigger 10 can be pressed down to trigger the switch 22 with its projecting end 13, and thus the nails in the nailer can be ejected. When the locking portion 11 is engaged in the recess 12 of the trigger 10, the locking portion 11 is integrally locked with the trigger 10 and form an enclosed structure, and the protrusion 111 of the locking portion 11 is also interlocked with the safety portion 21 of the main body 20 of the nailer, at this moment, the trigger 10 cannot be pressed down, and thus preventing the accident of pressing the trigger by mistake. However, this conventional safety switch for an electric nailer still has some problems that will be caused in real operation:

First, when the electric nailer is set in safe mode, the locking portion 11 needs to be interlocked with the trigger 10 and form an integral enclosed structure, thus, the entire structural strength of the trigger 10 must be improved, just for this reason, it is not easy for the user to make the locking portion 11 engage and disengage the recess 12 of the trigger 10, thus inconveniences are caused in operation.

Second, the locking portion 11 only can be integrally interlocked with the trigger 10 after it is pressed down so as to set the electric nailer in safe mode, if the user forgot to press the locking portion 11 down after use, the trigger 10 still can be pulled. In short, the electric nailer cannot be turned into safety mode automatically after use.

Referring to FIGS. 3, 4 and 5, which show another conventional electric nailer equipped with a safety switch. A safety rod 41 is slidably disposed between a trigger 30 and a main body 40 of an electric nailer. The safety rod 41 is formed with a notch 411, and the trigger 30 is formed with a nose portion 31. When the user press the safety rod 41 to make the nose portion 31 of the trigger 30 engage the notch 411 of the safety rod 41, an actuating portion 32 of the trigger 30 can be pulled down to actuate the switch 42. When the user presses the safety rod 41 conversely to disengage the nose portion 31 of the trigger 30 from the notch 411, the nose portion 31 will abut against the safety rod 41, thus the trigger 30 cannot be pressed, and thus preventing the accident of pressing the trigger by mistake. However, this conventional safety switch for an electric nailer still has the following problems will be caused in real operation:

First, the trigger 30 and the safety rod 41 are engaged with each other, and they are disposed inside the main body of the nailer, thus, just looking from the outside, it is not easy for the user to judge if the electric nailer is set in safety mode or in an operating mode.

Second, the safety rod 41 must be pressed down by the user then it can be locked with the trigger 30 so as to set the nailer in safe mode, if the user forgot to press the locking portion 11 down after each time of use, the trigger 10 still can be pulled. In short, the electric nailer cannot be turned into safety mode automatically when not in use, thus the trigger may be pulled by mistake.

The present invention has arisen to mitigate and/or obviate the afore-described disadvantages.

SUMMARY OF THE INVENTION

The primary object of the present invention is to provide a safety switch for an electric nailer which is capable of returning the eletric nailer to safe mode automatically when the electric nailer is not in use, and thus preventing an accident of pressing the trigger by mistake.

A safety switch for an electric nailer is provided in accordance with the present invention, the electric nailer is equipped with a trigger which can return to its original position after being pressed, and the safety switch comprises:

a stop portion is formed in the electric nailer;

a safety member includes a push plate and an abutting portion, wherein the safety member is fixed in the electric nailer and can return to its original position after being pressed, the push plate serves to cover the trigger, and the abutting portion abuts against the stop portion.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
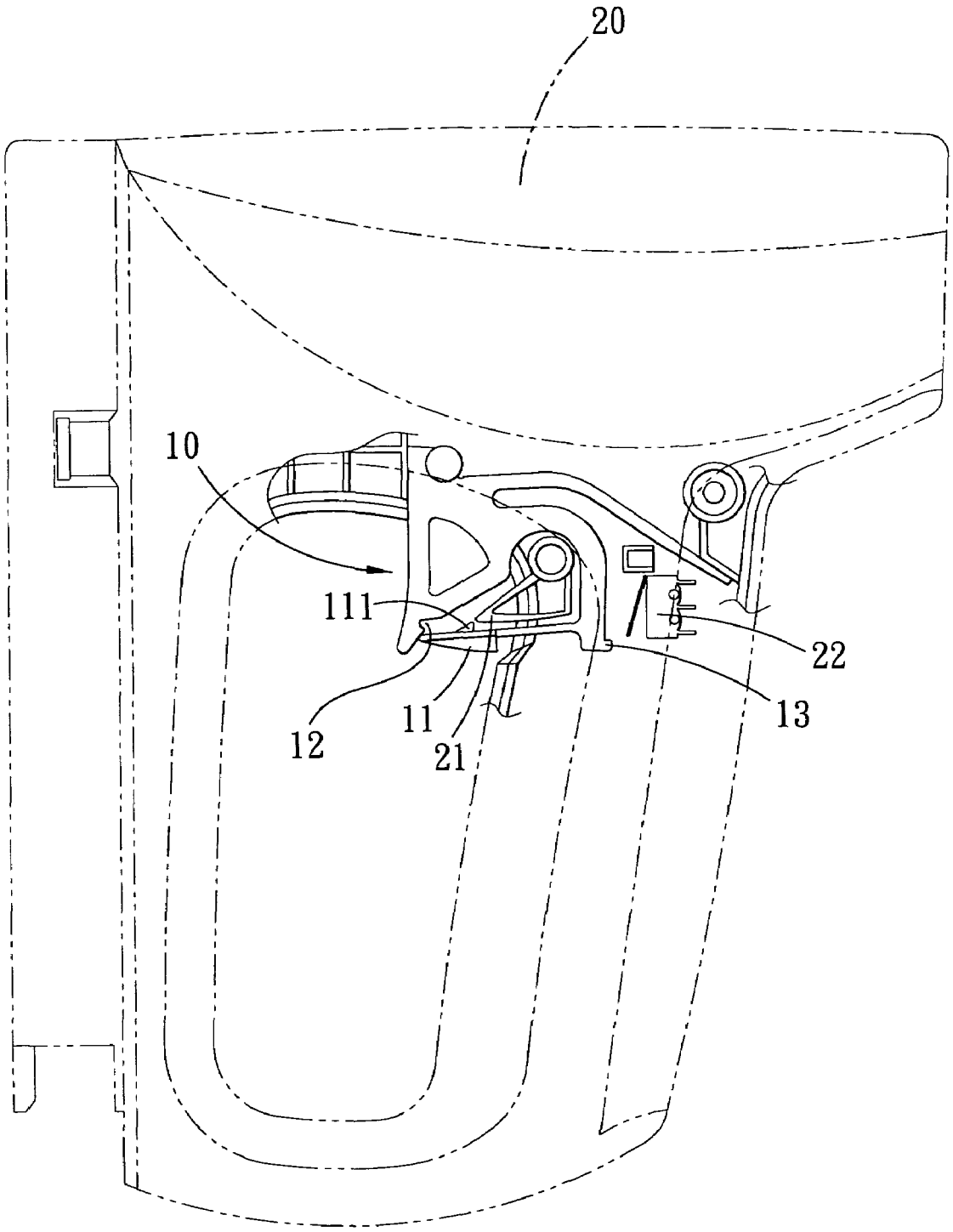
FIG. 1 PRIOR ART
FIG. 1 shows a safety switch for a conventional electric nailer is being set in an operating mode.
Figure 2:
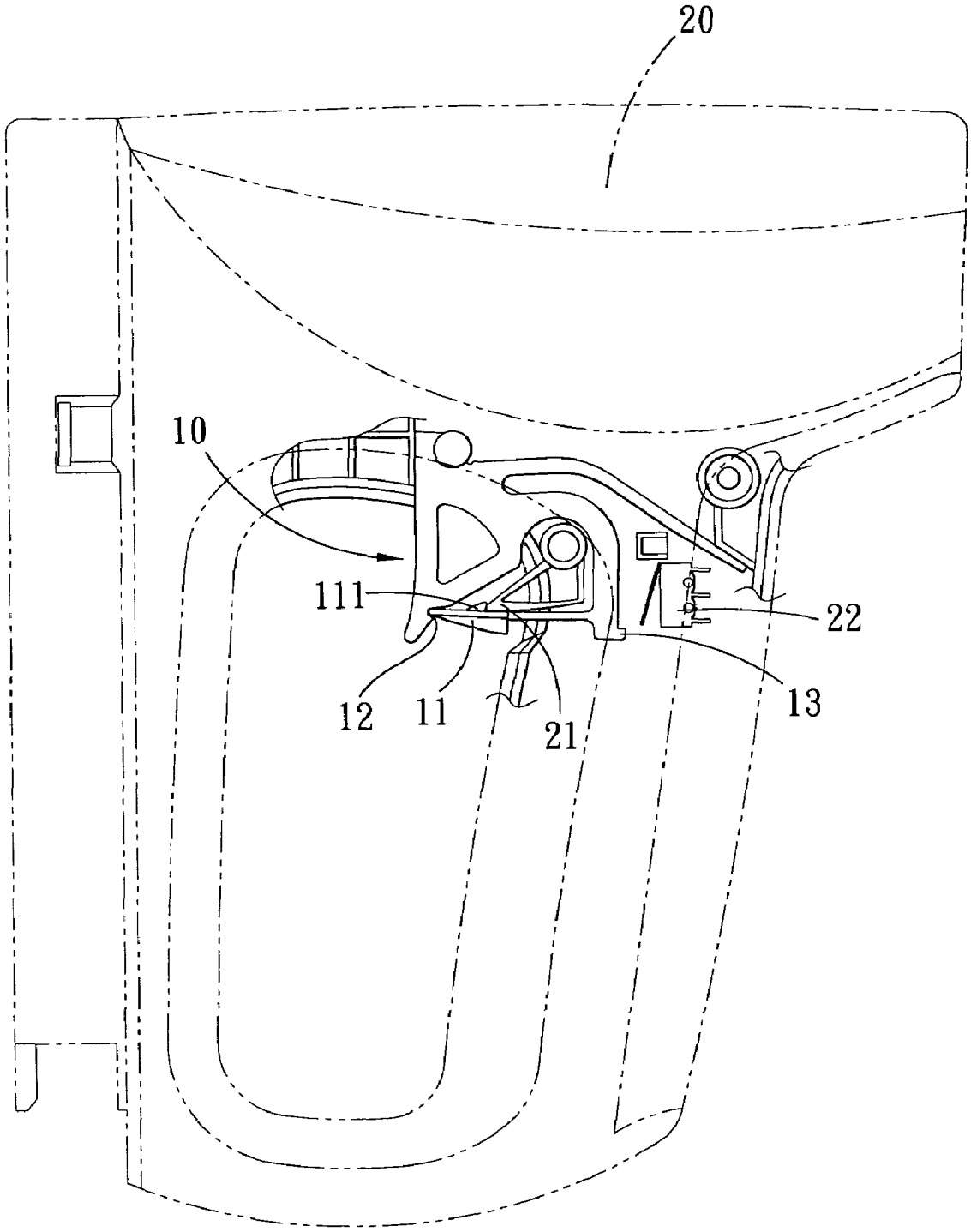
FIG. 2 PRIOR ART
FIG. 2 shows a safety switch for a conventional electric nailer is being set in a safe mode.
Figure 3:
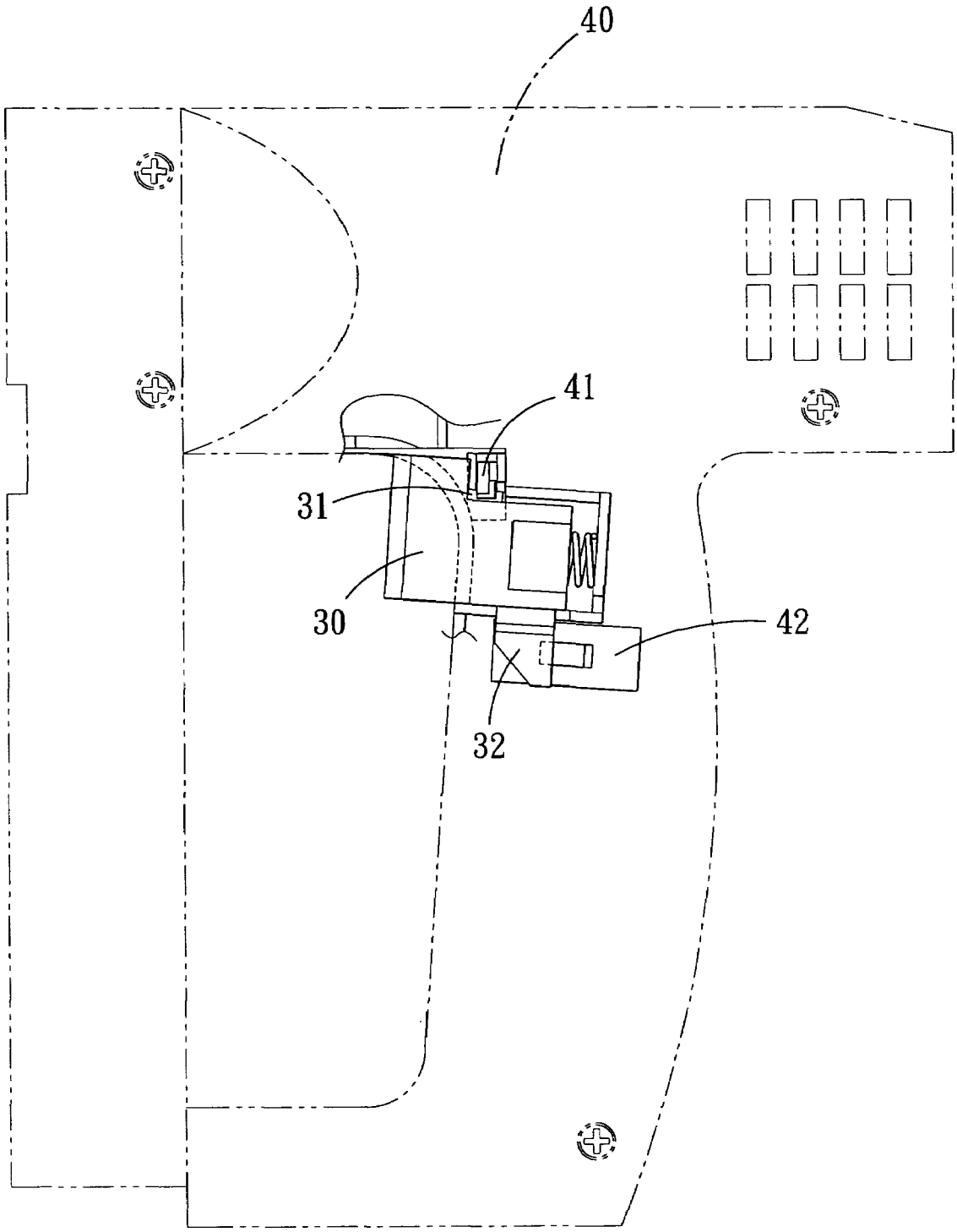
FIG. 3 PRIOR ART
FIG. 3 is a side view of another safety switch for a conventional electric nailer.
Figure 4:
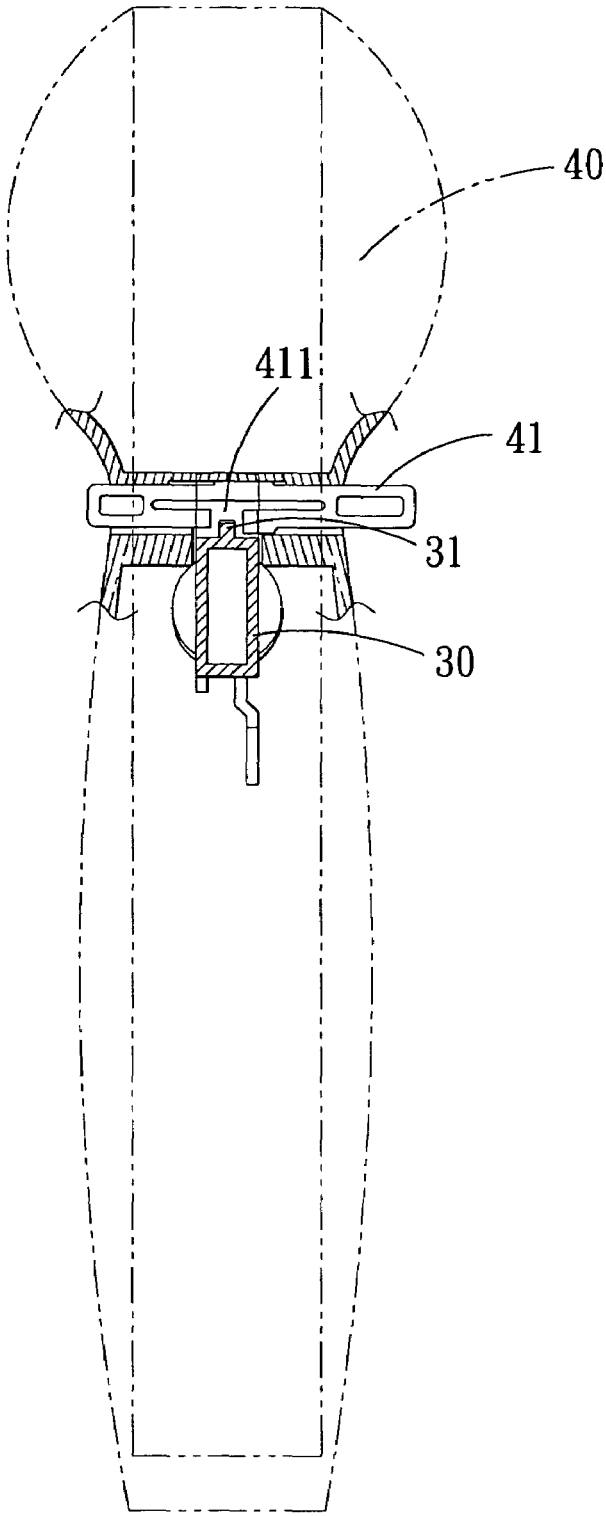
FIG. 4 PRIOR ART
FIG. 4 shows another safety switch for a conventional electric nailer is being set in an operating mode.
Figure 5:
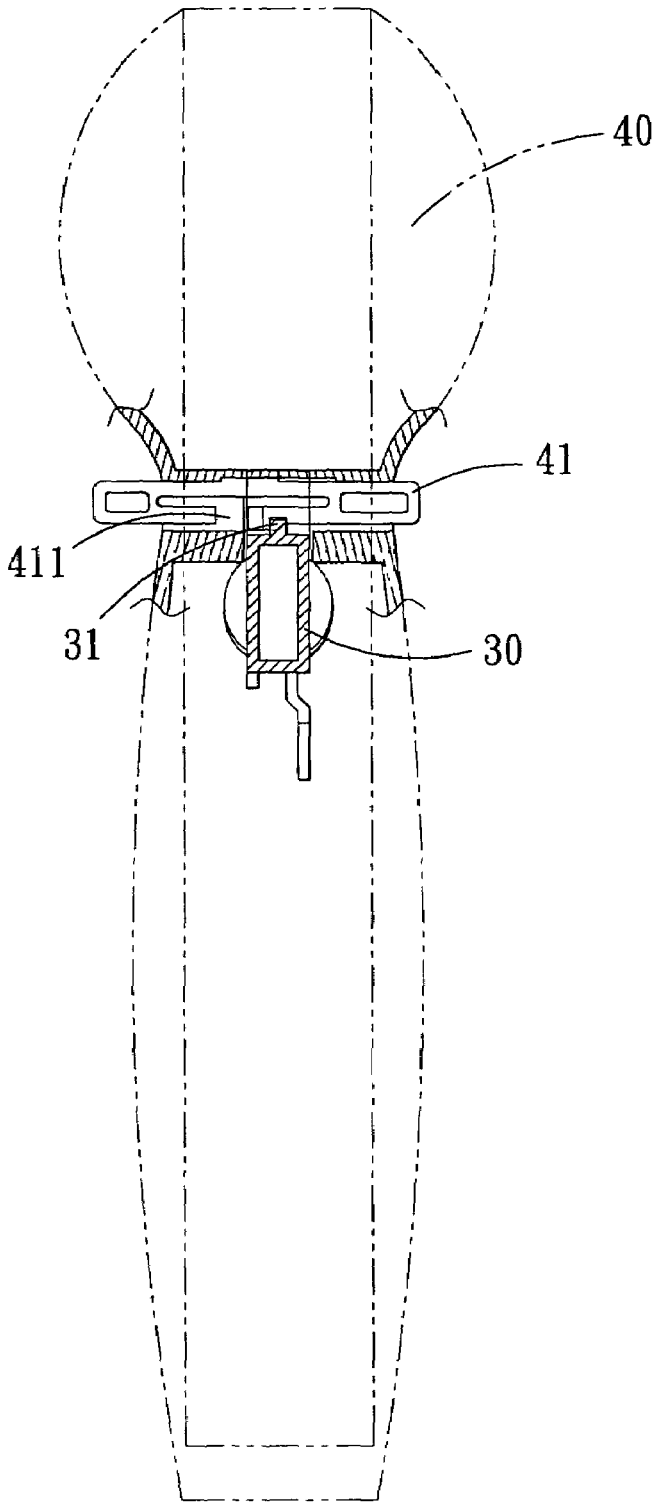
FIG. 5 PRIOR ART
FIG. 5 shows another safety switch for a conventional electric nailer is being set in a safe mode.
Figure 6:
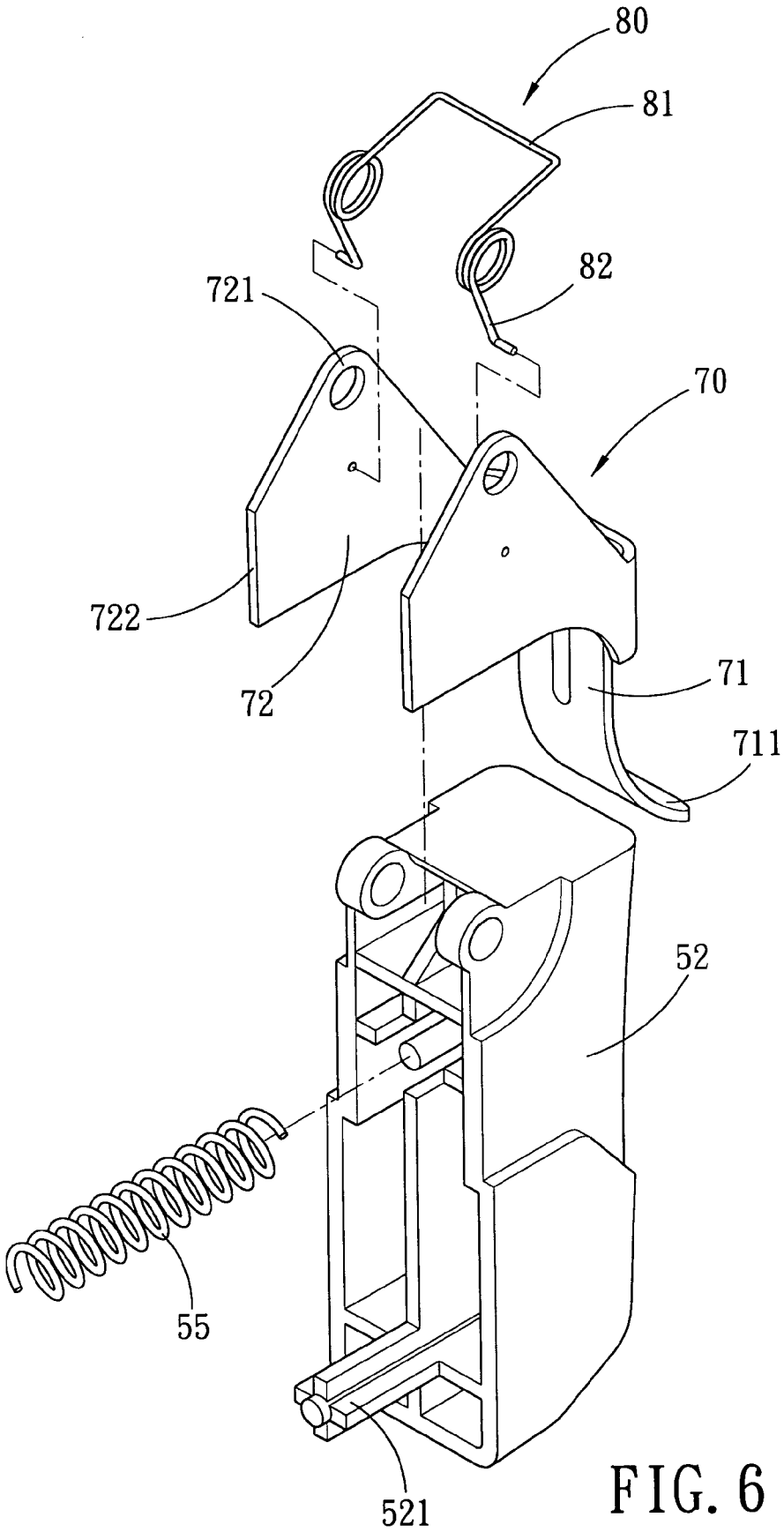
FIG. 6 is an exploded view of a safety switch for an electric nailer in accordance with a first embodiment of the present invention.
Figure 7:
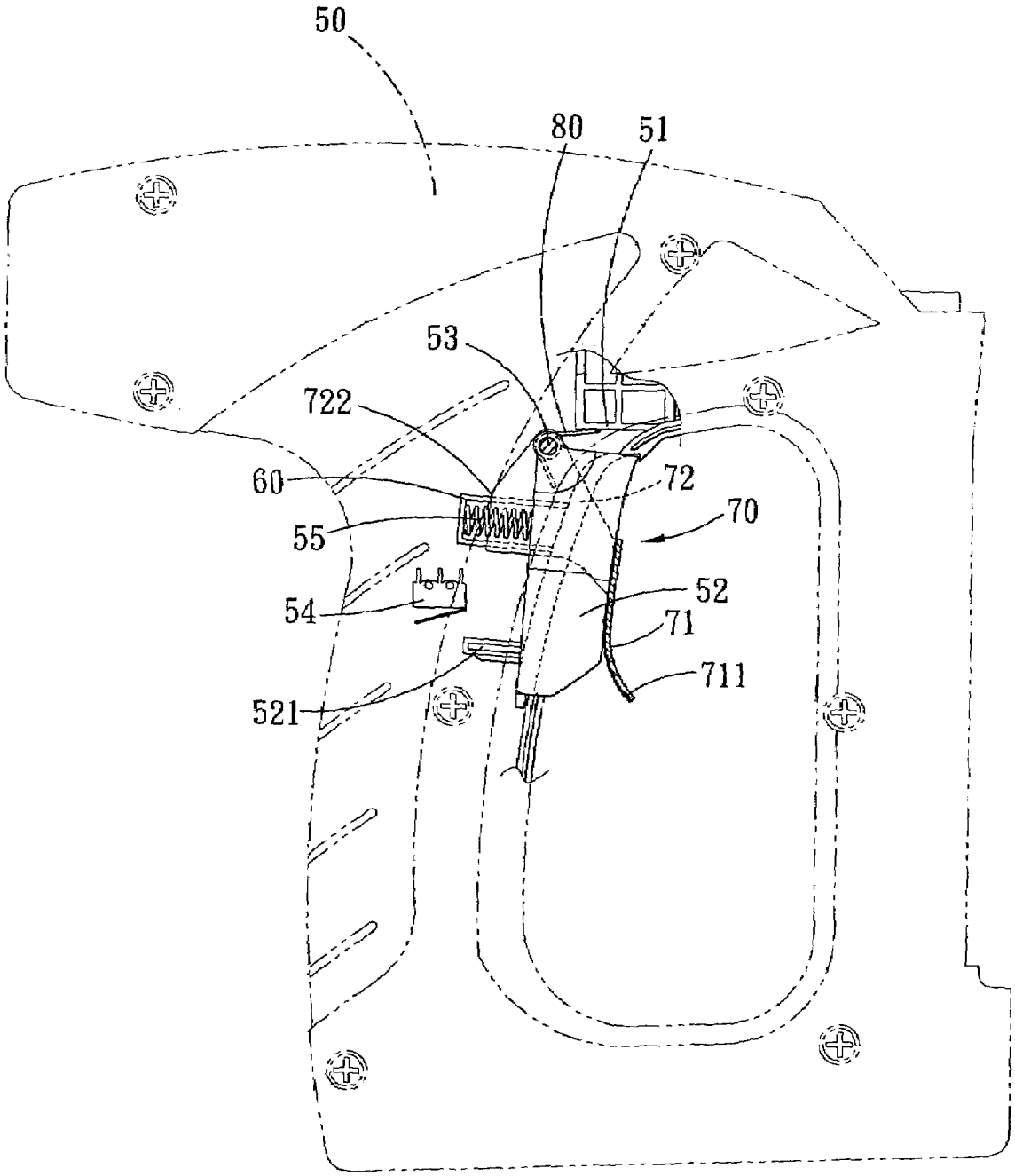
FIG. 7 is an assembly side view of a safety switch for an electric nailer in accordance with the first embodiment of the present invention.

Referring to FIGS. 6 and 7, which show a safety switch for an electric nailer in accordance with a first embodiment of the present invention. A main body 50 of the electric nailer is interiorly provided with a limiting portion 51, and a trigger 52 is provided on a handle portion of the electric nailer. An end of the trigger 52 is pivotally fixed in the main body 50 via a pin 53, and another end of the trigger 52 is actuating portion 521 serving to trigger a switch 54. Between the trigger 52 and the main body 50 is disposed a compression spring 55 which serves to push the trigger 52 back to its original position after each press. The safety switch assembly generally comprises a stop portion 60 and a safety member 70.

The stop portion 60 is a hollowly configured and disposed in the main body 50 of an electric nailer, so that an end of the compression spring 55 engages in the hollow space of the stop portion 60.

The safety member 70 comprises a push plate 71 and two opposite abutting portions 72 disposed at both sides of the push plate 71. A free end 711 of the covering portion 71 is curved upward. Each of the abutting portions 72 has a pivoting portion 721 and an abutting end 722, the pivoting portion 721 is pivotally assembled to the pin 53, and meanwhile, a torsion spring 80 is pivotally assembled on the pin 53 in such a manner a first end 81 of the torsion spring 80 abuts against the limiting portion 51 of the main body 50 and a second end 82 of which is inserted in the abutting portion 72 of the safety member 70. By such arrangements, the safety member 70 is installed in the main body 50 in such a manner that it can be returned to its original position automatically after being pressed, and the push plate 71 keeps covering the trigger 52 while the abutting end 722 of the abutting portion 72 keeps abutting against the stop portion 60.

Figure 8:
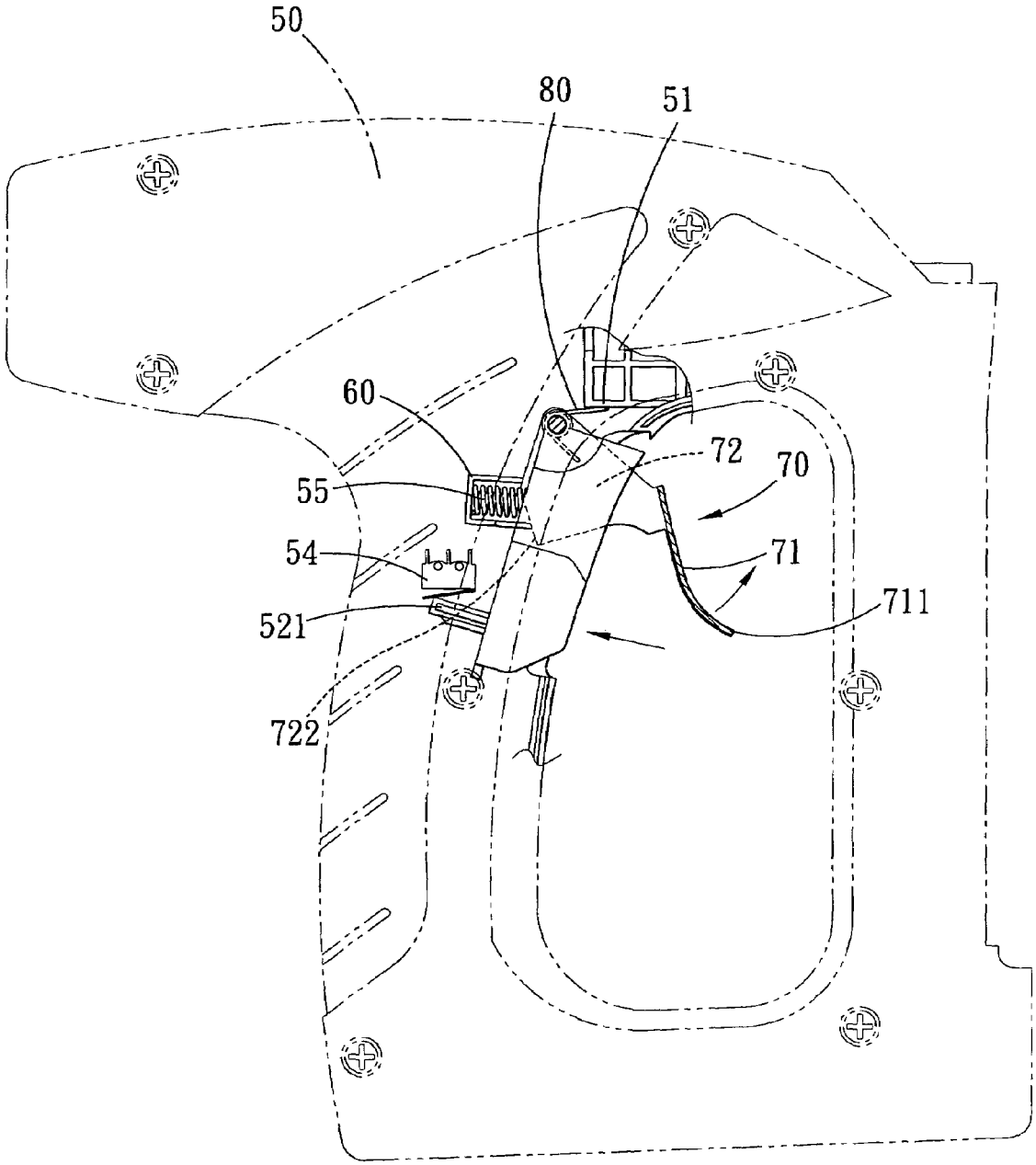
FIG. 8 shows a safety switch for an electric nailer in accordance with the first embodiment of the present invention is being set in a working mode.

Referring further to FIGS. 7 and 8, the user has to press the push plate 71 of the safety member 70 before pressing the trigger 52 due to the trigger 52 is covered by the push plate 71 of the safety member 70. Since the abutting end 722 of the abutting portion 72 of the safety member 70 abuts against the stop portion 60, the user is unable to actuate the trigger 52 by pressing the safety member 70. Before pressing the safety member 70, the user has to pull the safety member 70 from the free end 711 of the push plate 71 with his finger, so as to disengage the abutting end 722 of the abutting portion 72 from the stop portion 60. At this moment, the finger is located between the safety member 70 and the trigger 52, thus the trigger 52 can be pressed down. Furthermore, the torsion spring 80 will be compressed and produce a torsion force when the user is pulling the safety member 70. Once the nail-ejecting operation is finished (the finger moves away from the space between the trigger 52 and the safety member 70), the safety member 70 will be pushed back to its original position by the torsion spring 80 (the push plate 71 of the safety member 70 will keep covering the trigger 52 again, and the abutting portion 72 will keep abutting against the stop portion 60). Thus, the electric nailer is set in safety mode automatically, and the accident of pressing the trigger 52 by mistake can be prevented.

Besides, the present invention further has the advantages as follows:

First, the user can pull the safety member 70 easily since the free end of the safety member 70 is curved upward.

Second, the electric nailer can be set in safe mode automatically when no in use, thus, no matter in use or in safe mode, the present invention can effectively prevent people who are unfamiliar with the electric nailer, especially the children, from being hurt by an accident of pressing the trigger by mistake.

Figure 9:
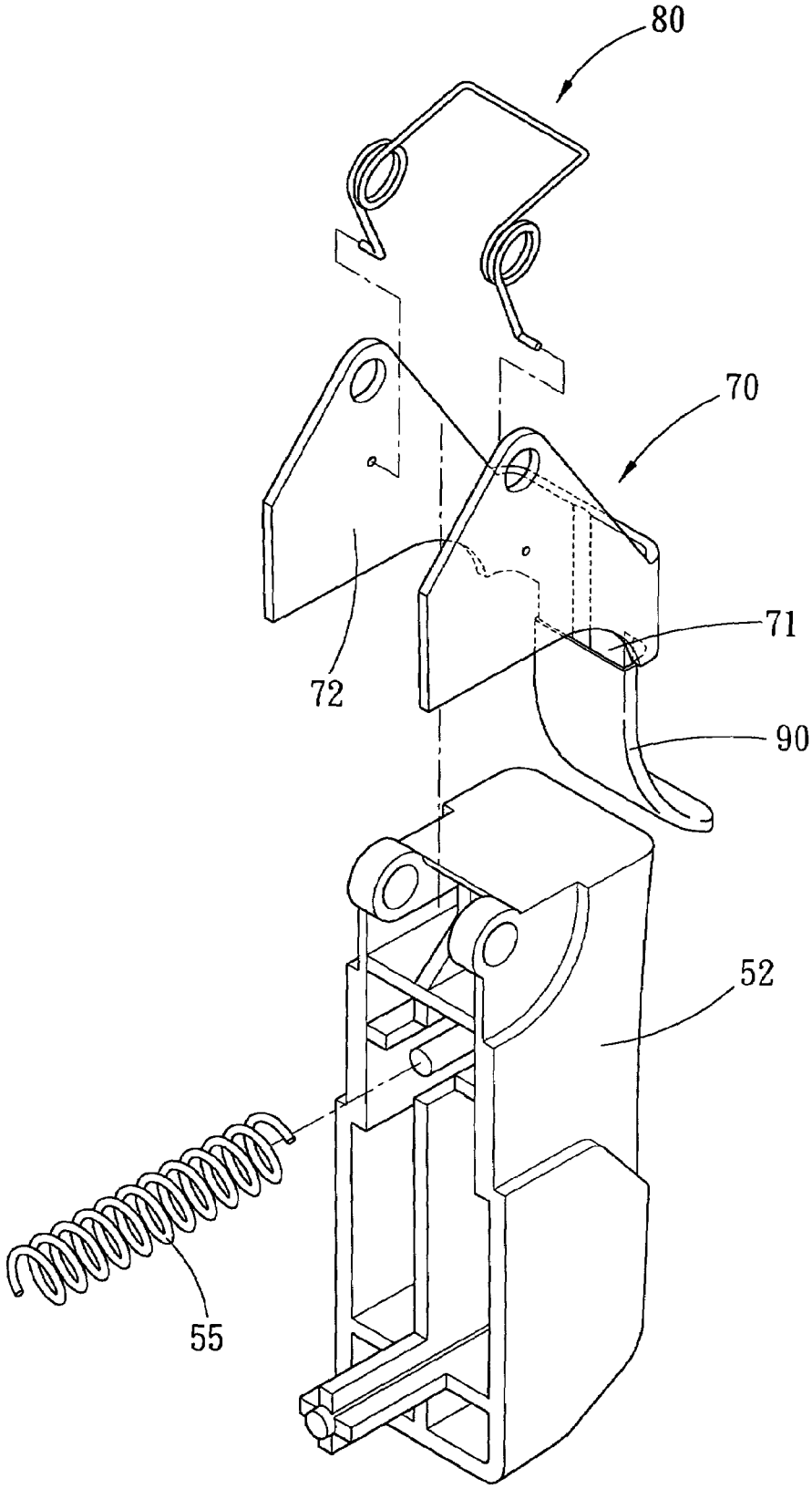
FIG. 9 is an exploded view of a safety switch for an electric nailer in accordance with a first embodiment of the present invention, wherein the push plate is covered with a cover.

It is to be noted that, as shown in FIG. 9, the pushed plate 71 of the safety member 70 can be covered with a protection cover 90 for preventing the user's finger from being scratched by the push plate 70.

Figure 10:
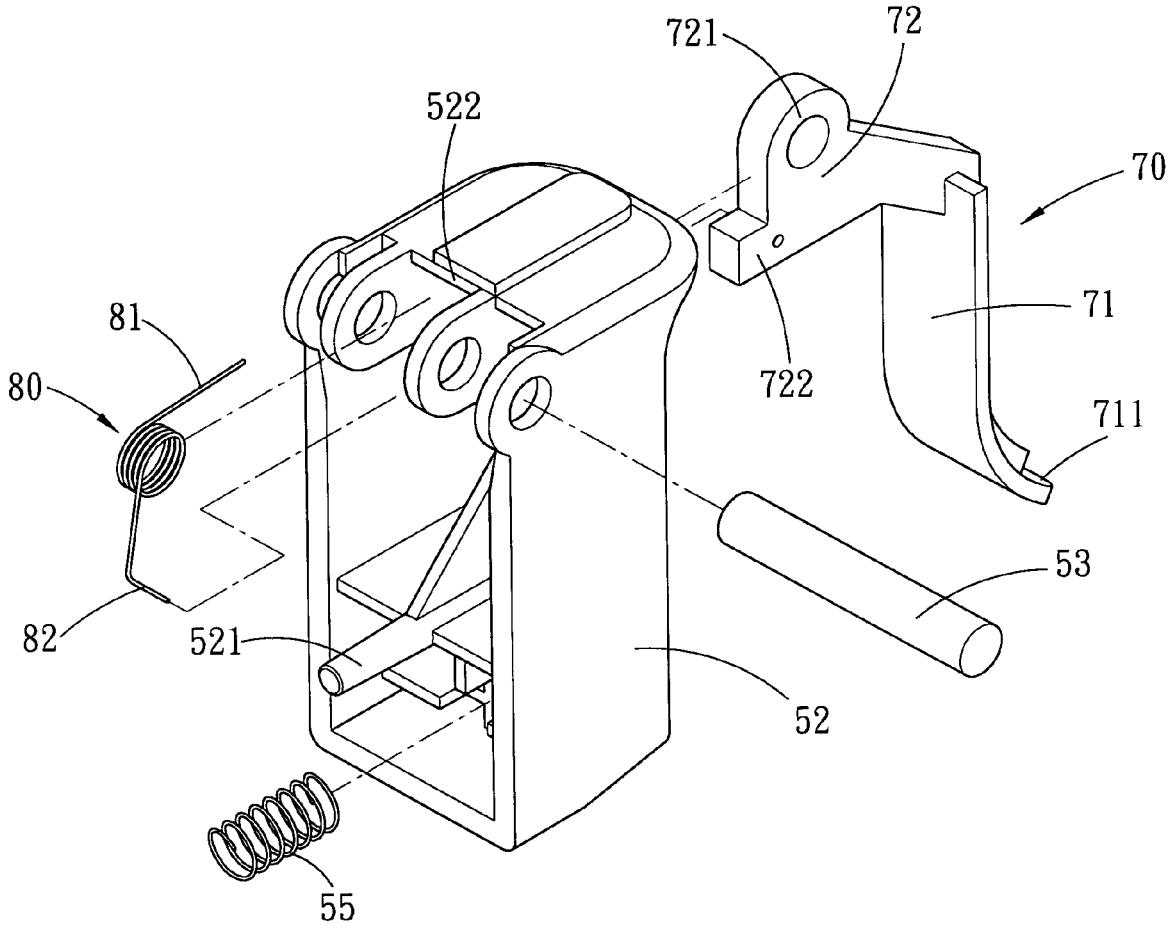
FIG. 10 is an exploded view of a safety switch for an electric nailer in accordance with a second embodiment of the present invention.
Figure 11:
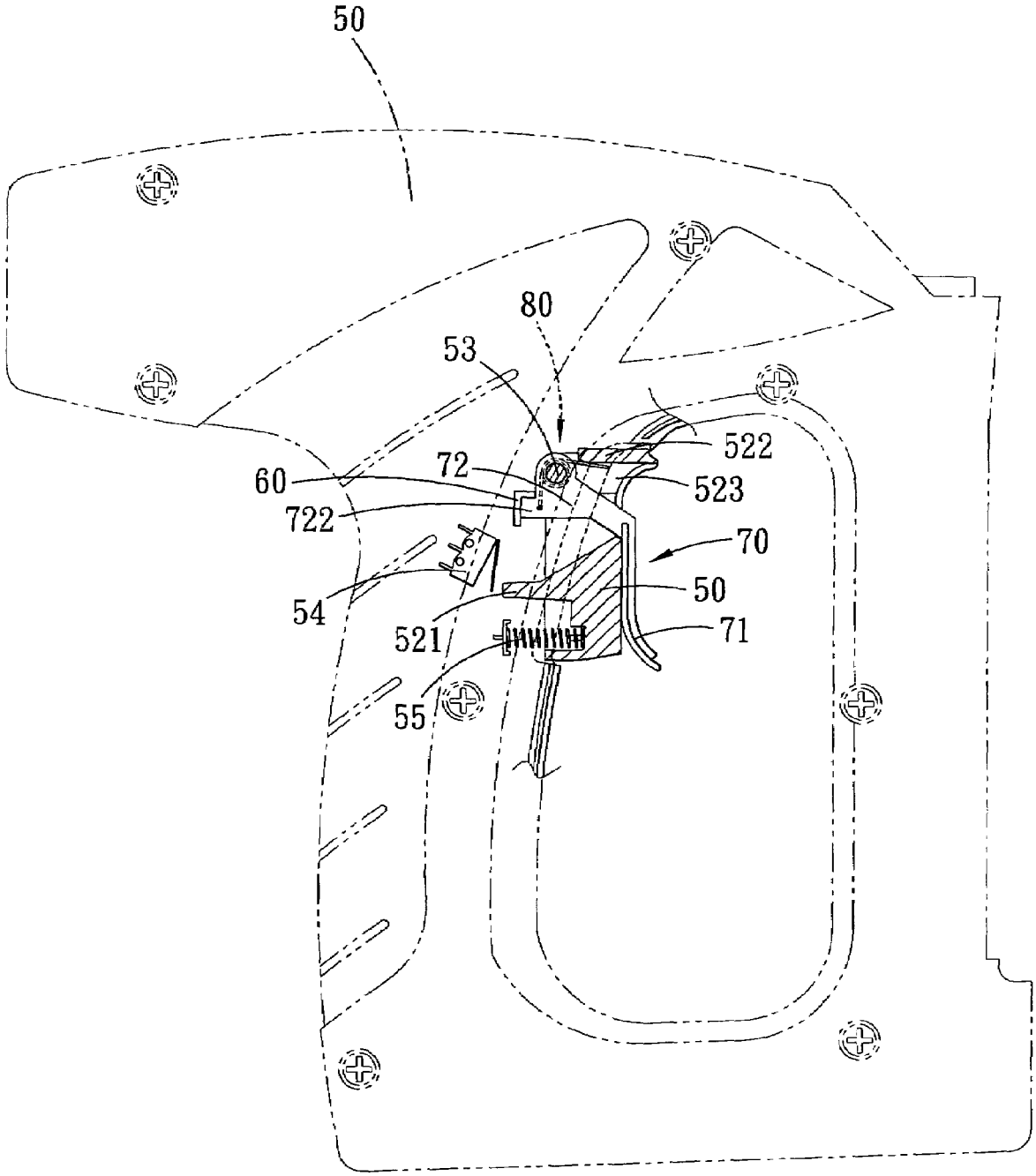
FIG. 11 is an assembly side view of a safety switch for an electric nailer in accordance with the second embodiment of the present invention.

Referring to FIGS. 10 and 11, which show a safety switch for an electric nailer in accordance with a second embodiment of the present invention. A trigger 52 is provided on the handle of the electric nailer, an upper end of the trigger 52 is formed with a limiting portion 522 and then pivotally fixed in the main body 50 of the electric nailer via a pin 53. Adjacent to a lower end of the trigger 52 is formed a actuating portion 521 which is employed to press the trigger 54. Furthermore, a through hole 523 is formed on the sidewall of the trigger 52, and a compression spring 55 is mounted on the trigger 52 and located in the main body 50, thus the trigger 52 will be pushed back to its original position after each pull. The safety switch generally comprises a stop portion 60 and a safety member 70.

The stop portion 60 is L-shaped and formed in the main body 50 of the electrical nailer.

The safety member 70 comprises a push plate 71 and an abutting portion 72 connected to an upper end of the push plate 71. A free end 711 of the push plate 71 is curved upward, and the abutting portion 72 has a pivoting end 721 and an abutting end 722. The abutting portion 72 is inserted in through hole 523 of the trigger 52, and the pivoting end 721 is pivotally assembled to the pin 53, meanwhile, a torsion spring 80 is pivotally assembled on the pin 53 in such a manner a first end 81 of the torsion spring 80 abuts against the limiting portion 522 of the trigger 52 and a second end 82 is inserted in the abutting portion 72 of the safety member 70. By such arrangements, the safety member 70 is installed in the main body 50 in such a manner that it can be returned to its original position automatically after each pull, and the push plate 71 keeps covering the trigger 52 while the abutting end 722 of the abutting portion 72 keeps abutting against the stop portion 60.

Figure 12:
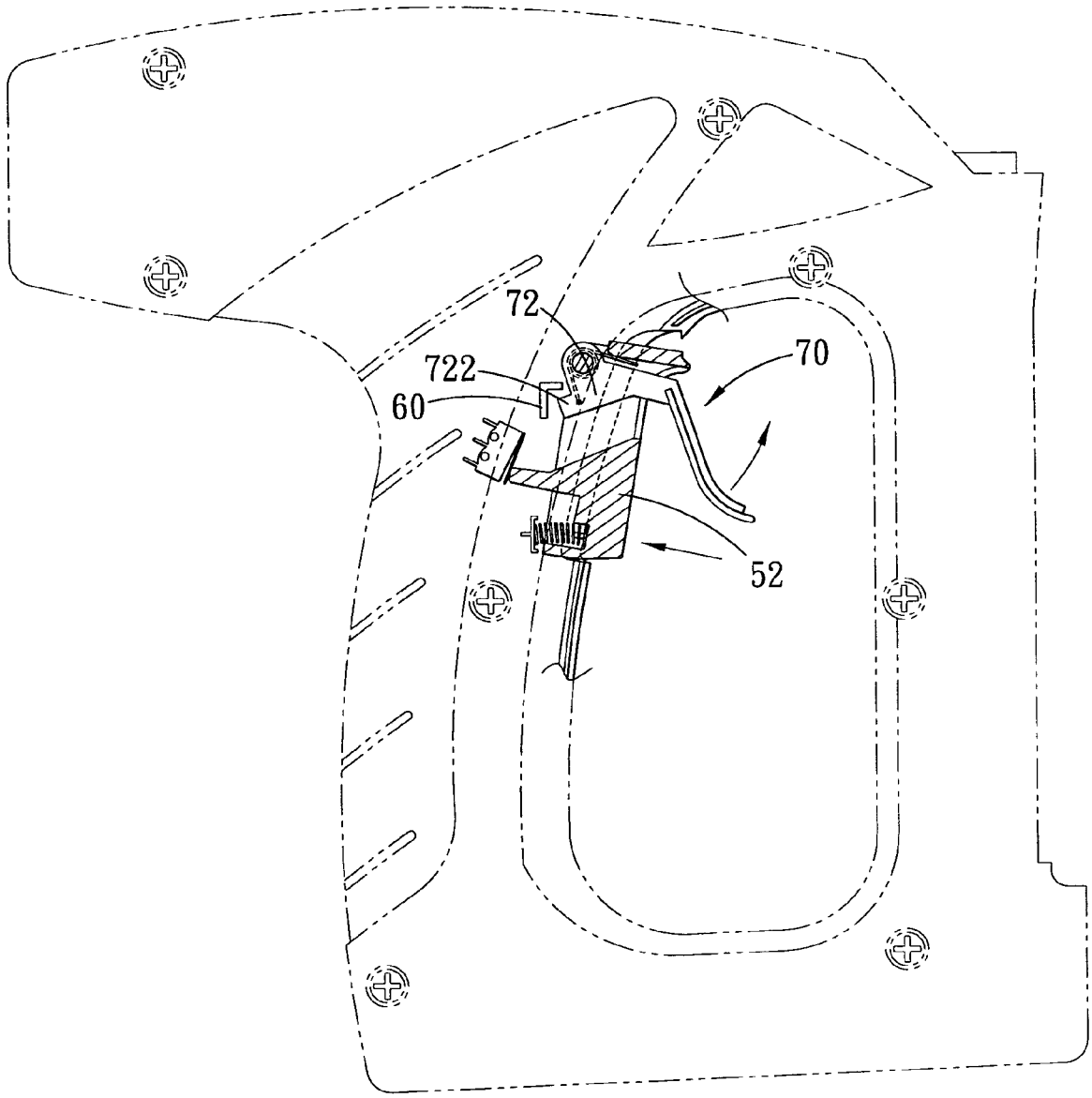
FIG. 12 shows a safety switch for an electric nailer in accordance with the second embodiment of the present invention is being set in a working mode.

Referring to FIG. 12, the operation manner in accordance with the second embodiment is identical to that of the first embodiment. The user can make the abutting end 722 of the abutting portion 72 disengage from the stop portion 60 by pulling the safety member 70, allowing the finger to insert between the safety member 70 and the trigger 52 and to pull the trigger 52. Thus, the operation and the function of the second embodiment is equivalent that of the first embodiment, so further remarks will be omitted.

While we have shown and described various embodiments in accordance with the present invention, it should be clear to those skilled in the art that further embodiments may be made without departing from the scope of the present invention.

What is claimed is:

1. A safety switch assembly for an electric nailer, the electric nailer equipped with a trigger which can return to its original position after being pressed, and the safety switch assembly comprising:

a stop portion formed in the electric nailer;

a safety member including a push plate and an abutting portion, wherein the safety member is fixed in the electric nailer and returns to an original position after being pressed to an open position, the push plate serves to cover the trigger, and the abutting portion abuts against the stop portion when in the original position such that the trigger cannot be actuated by the user, wherein the trigger can be actuated when the safety member is pressed to the open position.

2. The safety switch assembly for an electric nailer as claimed in claim 1, wherein a torsion spring is used to urge the push plate of the safety member to cover the trigger and to urge the abutting portion to abut the stop portion.

3. The safety switch assembly for an electric nailer as claimed in claim 2, wherein a limiting portion is formed in the electric nailer, an end of the torsion spring abuts against the limiting portion and another end of the torsion spring is fixed to the safety member, such that the safety member is returned to its original position after being pressed.

4. The safety switch assembly for an electric nailer as claimed in claim 2, wherein a limiting portion is formed on an upper end of the trigger, an end of the torsion spring abuts against the limiting portion and another end of the torsion spring is fixed to the safety member, such that the safety member is returned to its original position after being pressed.

5. The safety switch assembly for an electric nailer as claimed in claim 1, wherein the push plate of the safety member is covered with a cover.

* * * * *